US009086067B2

(12) United States Patent
Masuda et al.

(10) Patent No.: US 9,086,067 B2
(45) Date of Patent: Jul. 21, 2015

(54) SCREW COMPRESSOR

(75) Inventors: Masanori Masuda, Osaka (JP); Hiromichi Ueno, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 97 days.

(21) Appl. No.: 13/881,849

(22) PCT Filed: Oct. 31, 2011

(86) PCT No.: PCT/JP2011/006088

§ 371 (c)(1),
(2), (4) Date: Apr. 26, 2013

(87) PCT Pub. No.: WO2012/056728

PCT Pub. Date: May 3, 2012

(65) Prior Publication Data

US 2013/0216418 A1 Aug. 22, 2013

(30) Foreign Application Priority Data

Oct. 29, 2010 (JP) ..... 2010-243403

(51) Int. Cl.
*F04C 2/00* (2006.01)
*F04C 18/52* (2006.01)
(Continued)

(52) U.S. Cl.
CPC . *F04C 2/00* (2013.01); *F04C 18/52* (2013.01); *F04C 29/061* (2013.01); *F04C 29/068* (2013.01); *F04C 29/122* (2013.01)

(58) Field of Classification Search
CPC ... F16L 55/08; F16L 55/0333; F16L 55/0331; F16L 55/04
USPC ..... 418/191, 195, 201.1–201.3, 85, 83; 417/310, 410.3, 410.4; 181/250, 273, 181/276, 403
See application file for complete search history.

(56) References Cited

U.S. PATENT DOCUMENTS 5,214,937 A 6/1993 Henrichs et al.
2006/0127235 A1 6/2006 Shoulders
2006/0285966 A1 12/2006 Gotoh et al.

FOREIGN PATENT DOCUMENTS

JP 59-119088 A 7/1984
JP 60-100590 U 7/1985
(Continued)

OTHER PUBLICATIONS

English Language Machine Translation of JP07332273.*
(Continued)

*Primary Examiner* — Kenneth Bomberg
*Assistant Examiner* — Wesley Harris
(74) *Attorney, Agent, or Firm* — Global IP Counselors

(57) ABSTRACT

A screw compressor includes a screw rotor, a casing and an economizer circuit. The screw rotor has a plurality of helical grooves forming a compression chamber. The casing has a cylinder portion with the screw rotor inserted in the cylinder portion. The economizer circuit ejects configured to eject intermediate pressure refrigerant into a compression chamber in the course of compression. The economizer circuit includes a branch passage configured to branch the intermediate pressure refrigerant from a portion of a refrigerant circuit, a resonance space connected to a downstream side of the branch passage to retain the intermediate pressure refrigerant, and a resonance passage having an end communicating with an interior of the compression chamber and an other end communicating with an interior of the resonance space. The refrigerant circuit circulates refrigerant and performs a refrigeration cycle.

6 Claims, 10 Drawing Sheets

(51) Int. Cl.
*F04C 29/06* (2006.01)
*F04C 29/12* (2006.01)

(56) References Cited

FOREIGN PATENT DOCUMENTS

| | | | |
|---|---|---|---|
| JP | 61-192890 | A | 8/1986 |
| JP | 63-9490 | U | 1/1988 |
| JP | 5-332278 | A | 12/1993 |
| JP | 7-332273 | A | 12/1995 |
| JP | 4140488 | B2 | 6/2008 |
| JP | 2008-523308 | A | 7/2008 |
| JP | 2010-185406 | A | 8/2010 |

OTHER PUBLICATIONS

English Language Machine Translation of JP07332273, Dec. 22, 1995.*

International Preliminary Report on Patentability and an English translation of Written Opinion of the International Searching Authority of corresponding international application No. PCT/JP2011/006088, May 23, 2013.

International Search Report of corresponding PCT Application No. PCT/JP2011/006088, Jan. 17, 2014.

* cited by examiner

SCREW COMPRESSOR

CROSS-REFERENCE TO RELATED APPLICATIONS

This U.S. National stage application claims priority under 35 U.S.C. §119(a) to Japanese Patent Application No. 2010-243403, filed in Japan on Oct. 29, 2010, the entire contents of which are hereby incorporated herein by reference.

TECHNICAL FIELD

The present disclosure relates to screw compressors.

BACKGROUND ART

Screw compressors have been conventionally widely used for applications of compressing refrigerant or air. For example, Japanese Patent No. 4140488 shows a screw compressor including a screw rotor on which a plurality of helical grooves are provided, and gate rotors each in which a plurality of gates are provided.

In the above screw compressor, the gate rotor rotates with the rotation of the screw rotor. The gates of the gate rotor relatively move from the start ends (ends at a suction side) toward the terminal ends (ends at a discharge side) of the meshed helical grooves, and the volume of a compression chamber which is closed gradually decreases. As a result, a fluid in the compression chamber is compressed.

In the compression chamber in the course of compression, an intermediate pressure refrigerant is ejected from the economizer port. This ejection can reduce the temperature of a discharge refrigerant in the screw compressor to a predetermined temperature or less to improve the performance of the screw compressor.

SUMMARY

Technical Problem

When a refrigerant flows through an economizer circuit (sub flow path) communicating with an economizer port, pipes in the economizer circuit vibrate due to the pressure pulsation of the refrigerant, and the vibration is propagated to the heat exchanger through the economizer circuit, resulting in occurrence of noise. As a remedy of the problem, oil is ejected into a portion of the economizer circuit or a muffler is provided to reduce noise.

However, such remedies increases the pressure loss of the refrigerant to reduce the ejection amount of the refrigerant, causing a problem where an economizer effect cannot be sufficiently obtained and the performance is deteriorated. Independently providing another muffler disadvantageously increases the cost.

In view of the problems described above, the present invention is developed. It is an object of the present invention to maintain a sufficient amount of refrigerant ejected into a compression chamber from an economizer circuit to improve the performance of a compressor, and to reduce noise due to pressure pulsation of the refrigerant.

Solution of the Problem

The present disclosure is directed to a screw compressor including: a screw rotor (40) in which a plurality of helical grooves (41) for forming a compression chamber (23) are formed; a casing (11) having a cylinder portion (16) into which the screw rotor (40) is inserted; and an economizer circuit (70) configured to eject intermediate pressure refrigerant into the compression chamber (23) in a course of compression. The following solution is provided.

Specifically, according to a first aspect of the invention, the economizer circuit (70) includes a branch passage (71) configured to branch the intermediate pressure refrigerant from a portion of a refrigerant circuit (1) that circulates refrigerant and performs a refrigeration cycle, a resonance space (72) connected to a downstream side of the branch passage (71) to retain the intermediate pressure refrigerant, and a resonance passage (73) having an end communicating with an interior of the compression chamber (23), and the other end communicating with an interior of the resonance space (72).

In the first aspect of the present disclosure, the economizer circuit (70) has the branch passage (71), the resonance space (72), and the resonance passage (73). The branch passage (71) branches the intermediate pressure refrigerant from the portion of the refrigerant circuit (1) that circulates refrigerant and performs a refrigeration cycle. The resonance space (72) is connected to a downstream side of the branch passage (71) to retain the intermediate pressure refrigerant. The resonance passage (73) has an end communicating with the interior of the compression chamber (23), and the other end communicating with the interior of the resonance space (72).

With such a configuration, a sound attenuation effect of the resonance space (72) can reduce the pressure pulsation of the refrigerant flowing through the economizer circuit (70) to achieve low noise. Besides, since another muffler does not have to be provided, cost is advantageously reduced, and the pressure loss of the refrigerant does not increase due to a muffler, and a sufficient amount of the refrigerant can be maintained. This can sufficiently obtain an economizer effect to improve the performance of the compressor.

If the resonance frequency of pipe pulsation of the interior of the resonance passage (73) is set to correspond to the suction frequency of the intermediate pressure refrigerant into the compression chamber (23) in the course of compression, a so-called supercharging effect of increasing the amount of refrigerant flowing into the compression chamber (23) from the resonance passage (73) can be obtained by the pipe resonance to improve refrigeration capacity and refrigeration efficiency.

In a second aspect of the present disclosure, in the screw compressor of the first aspect, the other end of the resonance passage (73) protrudes toward the interior the resonance space (72).

In a third aspect of the present disclosure, in the screw compressor of the second aspect, a downstream end of the branch passage (71) protrudes toward the interior the resonance space (72).

In the second aspect of the present disclosure, the other end of the resonance passage (73) protrudes toward the interior the resonance space (72). In the third aspect of the present disclosure, the downstream end of the branch passage (71) protrudes toward the interior the resonance space (72).

With such a configuration, the lengths of the branch passage (71) and the resonance passage (73) which protrude toward the interior of the resonance space (72) are adjusted as appropriate, thereby obtaining a proper sound attenuation effect.

In a fourth aspect of the present disclosure, in the screw compressor of the first aspect, a distance L[m] from an inner peripheral surface of the cylinder portion (16) to the other end of the resonance passage (73) is set to satisfy the following expression:

$$L=c/4f$$

where c is a velocity of sound c[m/s], and f is a resonance frequency f[Hz].

In the fourth aspect of the present disclosure, the distance L[m] from the inner peripheral surface of the cylinder portion (16) to the other end of the resonance passage (73) is set to satisfy the expression described above. With such a setting, the pipe resonance can increase the amount of refrigerant flowing into the compression chamber (23) from the resonance passage (73) to improve refrigeration capacity and refrigeration efficiency.

Specifically, if the rotation speed of the screw rotor (40) is 60 Hz, and the number of the helical grooves (41) of the screw rotor (40) (the number of the compression chambers (23)) is six, the suction frequency of the intermediate pressure refrigerant into the compression chamber (23) in the course of compression, i.e., the resonance frequency f[Hz] is expressed by the following expression: f=60×6=360 [Hz]. If the velocity of sound c is 150 [m/s], the distance L from the inner peripheral surface of the cylinder portion (16) to the other end of the resonance passage (73) may be set by the following expression: L[m]=150/(4×360)=0.104 [m].

With such a setting, the resonance frequency of pipe pulsation of the interior of the resonance passage (73) is set to correspond to the suction frequency of the intermediate pressure refrigerant into the compression chamber (23) in the course of compression, and the antinode that is the maximum amplitude in the pipe pulsation is located at an opening end of the inner peripheral surface of the cylinder portion (16). As a result, such a pipe resonance can increase the amount of refrigerant flowing into the compression chamber (23) from the resonance passage (73) to improve refrigeration capacity and refrigeration efficiency.

In a fifth aspect of the present disclosure, in the screw compressor of the first aspect, the resonance passage (73) has a resonance pipe (73*a*) that is cylindrically shaped, and attached to the cylinder portion (16), and a plurality of economizer ports (73*b*) formed in the cylinder portion (16) to be arranged within the resonance pipe (73*a*) and along a land portion (41*a*) of one of the helical grooves (41) of the screw rotor (40) when viewed from a pipe axis direction of the resonance pipe (73*a*).

In the fifth aspect of the present disclosure, the resonance passage (73) has the resonance pipe (73*a*) that is cylindrically shaped, and attached to the cylinder portion (16) and the plurality of economizer ports (73*b*) formed in the cylinder portion (16). The economizer ports (73*b*) are formed so as to be arranged within the resonance pipe (73*a*) and along a land portion (41*a*) of one of the helical grooves (41) of the screw rotor (40) when viewed from the pipe axis direction of the resonance pipe (73*a*).

With such a configuration, since the economizer port (73*b*) are closed by the land portion (41*a*) of one of the helical grooves (41), the adjacent compression chambers (23) do not communicate with each other through the economizer port (73*b*), and as a result, compression efficiency is improved.

In a sixth aspect of the present disclosure, in the screw compressor of the first aspect, the resonance passage (73) has a resonance pipe (73*a*) that is cylindrically shaped and attached to the cylinder portion (16), and an elliptical economizer port (73*b*) formed in the cylinder portion (16) to extend within the resonance pipe (73*a*) and along a land portion (41*a*) of one of the helical grooves (41) of the screw rotor (40) when viewed from a pipe axis direction of the resonance pipe (73*a*).

In the sixth aspect of the present disclosure, the resonance passage (73) has the resonance pipe (73*a*) that is cylindrically shaped, and attached to the cylinder portion (16), and the economizer port (73*b*) formed in the cylinder portion (16). The elliptical economizer port (73*b*) is formed so as to extend within the resonance pipe (73*a*) and along a land portion (41*a*) of one of the helical grooves (41) of the screw rotor (40) when viewed from the pipe axis direction of the resonance pipe (73*a*).

With such a configuration, since the economizer port (73*b*) is closed by the land portion (41*a*) of one of the helical grooves (41), the adjacent compression chambers (23) do not communicate with each other through the economizer port (73*b*), and as a result, compression efficiency is improved.

In a seventh aspect of the present disclosure, in the screw compressor of the first aspect, the resonance space (72) is formed to surround an outer periphery of the cylinder portion (16).

In the seventh aspect of the present disclosure, the resonance space (72) is formed to surround the outer periphery of the cylinder portion (16). With such a configuration, the intermediate pressure refrigerant is allowed to flow into the resonance space (72) to be able to keep the temperature around the cylinder portion (16) constant. As a result, the screw rotor (40) and the cylinder portion (16) do not contact with each other due to the thermal expansion difference between the screw rotor (40) and the cylinder portion (16) due to the temperature difference therebetween, and seizing of the screw rotor (40) can be prevented.

In an eighth aspect of the present disclosure, the screw compressor of the first aspect of the present disclosure may further include: an economizer sleeve (85) having a smaller-diameter pipe portion (85*a*) attached to the cylinder portion (16) and communicating with the interior of the compression chamber (23), and a larger-diameter pipe portion (85*b*) formed in a shape of a cylinder, having a diameter larger than that of the smaller-diameter pipe portion (85*a*), and having an end connected to the smaller-diameter pipe portion (85*a*) and the other end open to an exterior of the casing (11); and an economizer flange (86) having a fitted pipe portion (86*a*) fitted into an interior of the larger-diameter pipe portion (85*b*), and a flange portion (86*b*) radially outwardly extending from an end of the fitted pipe portion (86*a*), wherein the resonance passage (73) is defined by the smaller-diameter pipe portion (85*a*) of the economizer sleeve (85), the branch passage (71) is defined by the fitted pipe portion (86*a*) of the economizer flange (86), and the resonance space (72) is a space formed by an inner surface of the pipe of the larger-diameter pipe portion (85*b*) of the economizer sleeve (85), and the fitted pipe portion (86*a*) of the economizer flange (86).

In the eighth aspect of the present disclosure, the economizer sleeve (85) is attached to the cylinder portion (16). The economizer sleeve (85) has the smaller-diameter pipe portion (85*a*) attached to the cylinder portion (16), and the larger-diameter pipe portion (85*b*) formed in the shape of a cylinder, and having a diameter larger than that of the smaller-diameter pipe portion (85*a*). The smaller-diameter pipe portion (85*a*) communicates with the interior of the compression chamber (23). The other end of the larger-diameter pipe portion (85*b*) is open to the exterior of the casing (11). The economizer flange (86) is attached to the economizer sleeve (85). The economizer flange (86) has the fitted pipe portion (86*a*), and the flange portion (86*b*). The fitted pipe portion (86*a*) is fitted into the interior of the larger-diameter pipe portion (85*b*). The flange portion (86*b*) radially outwardly extending from the end of the fitted pipe portion (86*a*). The resonance passage (73) is defined by the smaller-diameter pipe portion (85*a*) of the economizer sleeve (85). The branch passage (71) is defined by the fitted pipe portion (86*a*) of the economizer flange (86). The resonance space (72) is a space formed by the inner surface of the larger-diameter pipe portion (85*b*) of the economizer sleeve (85), and the fitted pipe portion (86*a*) of the economizer flange (86).

With such a configuration, the interior height of the resonance space (72) can be adjusted by moving the economizer flange (86) back and forth with respect to the economizer sleeve (85). This adjustment can provide an appropriate interior height of the resonance space (72) enough to reduce the pressure pulsation of the refrigerant flowing through the economizer circuit (70) by a sound attenuation effect, and low noise can be achieved.

Advantages of the Invention

According to the present disclosure, the pressure pulsation of the refrigerant flowing through the economizer circuit (70) can be reduced by a sound attenuation effect, and low noise can be achieved. Besides, since another muffler does not have to be provided, cost is advantageously reduced, and the pressure loss of the refrigerant does not increase due to a muffler, and as a result, a sufficient amount of the refrigerant can be maintained. This can sufficiently obtain an economizer effect to improve the performance of the compressor.

If the resonance frequency of pipe pulsation of the interior of the resonance passage (73) is set to correspond to the suction frequency of the intermediate pressure refrigerant into the compression chamber (23) in the course of compression, the amount of refrigerant flowing into the compression chamber (23) from the resonance passage (73) can be increased by the pipe resonance, and refrigeration capacity and refrigeration efficiency can be improved.

BRIEF DESCRIPTION OF THE DRAWINGS

FIG. 7A shows a suction stroke, FIG. 7B shows a compression stroke, and FIG. 7C shows a discharge stroke.

DESCRIPTION OF EMBODIMENTS

Embodiments of the present disclosure will be described hereinafter with reference to the drawings. The following embodiments are merely preferred examples in nature, and are not intended to limit the invention and the uses or applications of the invention.

<<First Embodiment>>

Figure 1:
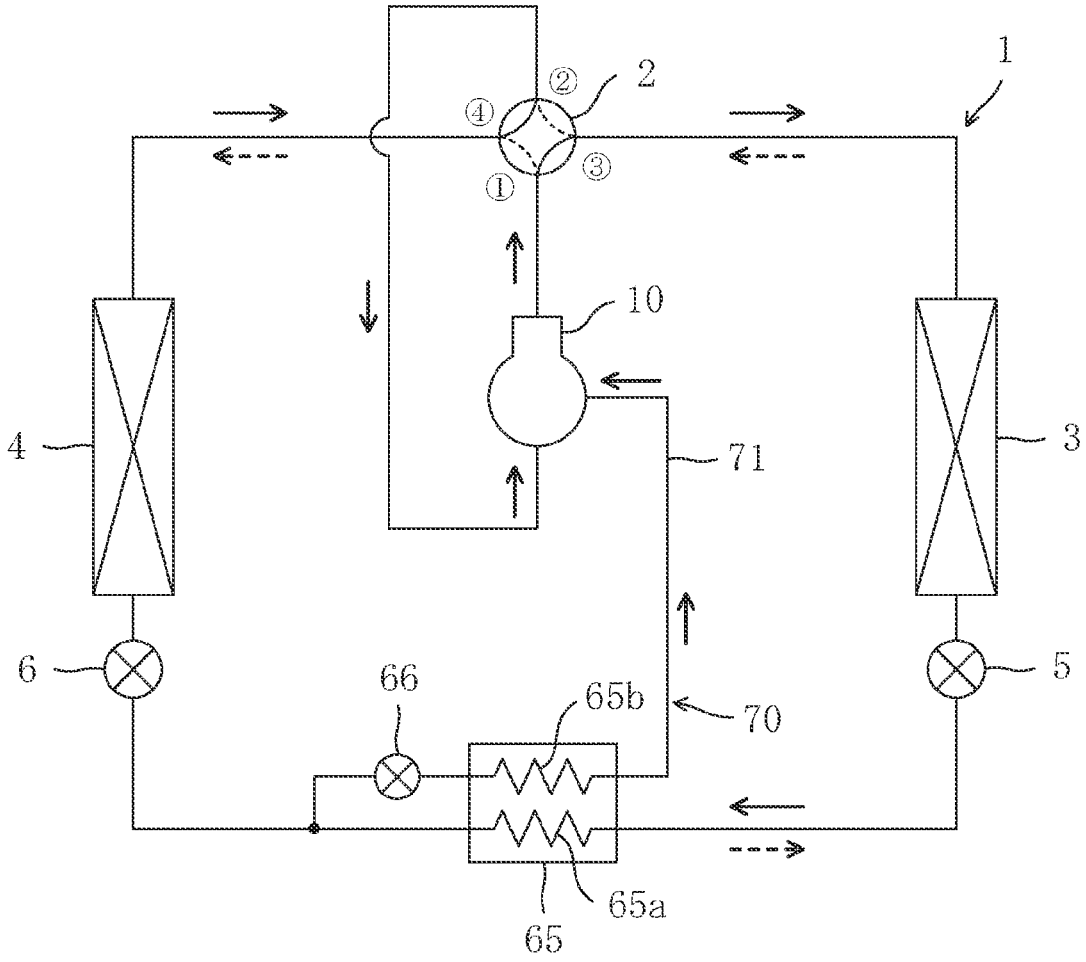
FIG. 1 is a refrigerant circuit diagram of an air conditioner including a screw compressor according to a first embodiment of the present disclosure.

FIG. 1 is a refrigerant circuit diagram of an air conditioner including a screw compressor according to a first embodiment of the present disclosure. As shown in FIG. 1, a refrigerant circuit (1) is a closed circuit provided with a screw compressor (10), a four-way switching valve (2), a heat-source-side heat exchanger (3), a utilization-side heat exchanger (4), a heat-source-side expansion valve (5), a utilization-side expansion valve (6), a supercooling heat exchanger (65), and an economizer circuit (70). The refrigerant circuit (1) is charged with refrigerant. The refrigerant circuit (1) circulates the charged refrigerant, thereby performing a vapor compression refrigeration cycle.

In the refrigerant circuit (1), a discharge side of the screw compressor (10) is connected to a first port of the four-way switching valve (2), and a suction side of the screw compressor (10) is connected to a second port of the four-way switching valve (2). An end of the heat-source-side heat exchanger (3) is connected to a third port of the four-way switching valve (2). The other end of the heat-source-side heat exchanger (3) is connected to an end of the supercooling heat exchanger (65). The other end of the supercooling heat exchanger (65) is connected to an end of the utilization-side heat exchanger (4) through the utilization-side expansion valve (6). The other end of the utilization-side heat exchanger (4) is connected to a fourth port of the four-way switching valve (2).

The four-way switching valve (2) is switchable between a first state (i.e., a state illustrated in a solid line of FIG. 1) in which the first port and the third port communicate with each other and the second port and the fourth port communicate with each other, and a second state (i.e., a state illustrated in a dotted line of FIG. 1) in which the first port and the fourth port communicate with each other and the second port and the third port communicate with each other.

The supercooling heat exchanger (65) has a high pressure side flow path (65*a*) and an intermediate pressure side flow path (65*b*), and is configured to exchange heat between the refrigerant flowing through the high pressure side flow path (65*a*) and the refrigerant flowing through the intermediate pressure side flow path (65*b*).

An end of the high pressure side flow path (65*a*) is connected to the heat-source-side heat exchanger (3) through the heat-source-side expansion valve (5). The other end of the high pressure side flow path (65*a*) is connected to the utilization-side heat exchanger (4) through the utilization-side expansion valve (6).

The intermediate pressure side flow path (65*b*) is connected to the economizer circuit (70). The economizer circuit (70) is configured to eject the refrigerant into the compression chamber (23) in the course of compression in the screw compressor (10), and includes a branch passage (71), and a resonance space (72) and a resonance passage (73) which are described later (see FIG. 2).

The upstream end of the branch passage (71) is connected to a refrigerant pipe between the heat-source-side heat exchanger (3) and the supercooling heat exchanger (65). The downstream end of the branch passage (71) is connected to an intermediate port that is open to an intermediate pressure position in the screw compressor (10).

In a portion of the branch passage CM, the supercooling pressure-reducing valve (66), and the intermediate pressure side flow path (65*b*) of the supercooling heat exchanger (65) sequentially provided from the upstream side of the branch passage (71). The supercooling pressure-reducing valve (66) is an electronic expansion valve whose degree of opening is variable.

Figure 2:
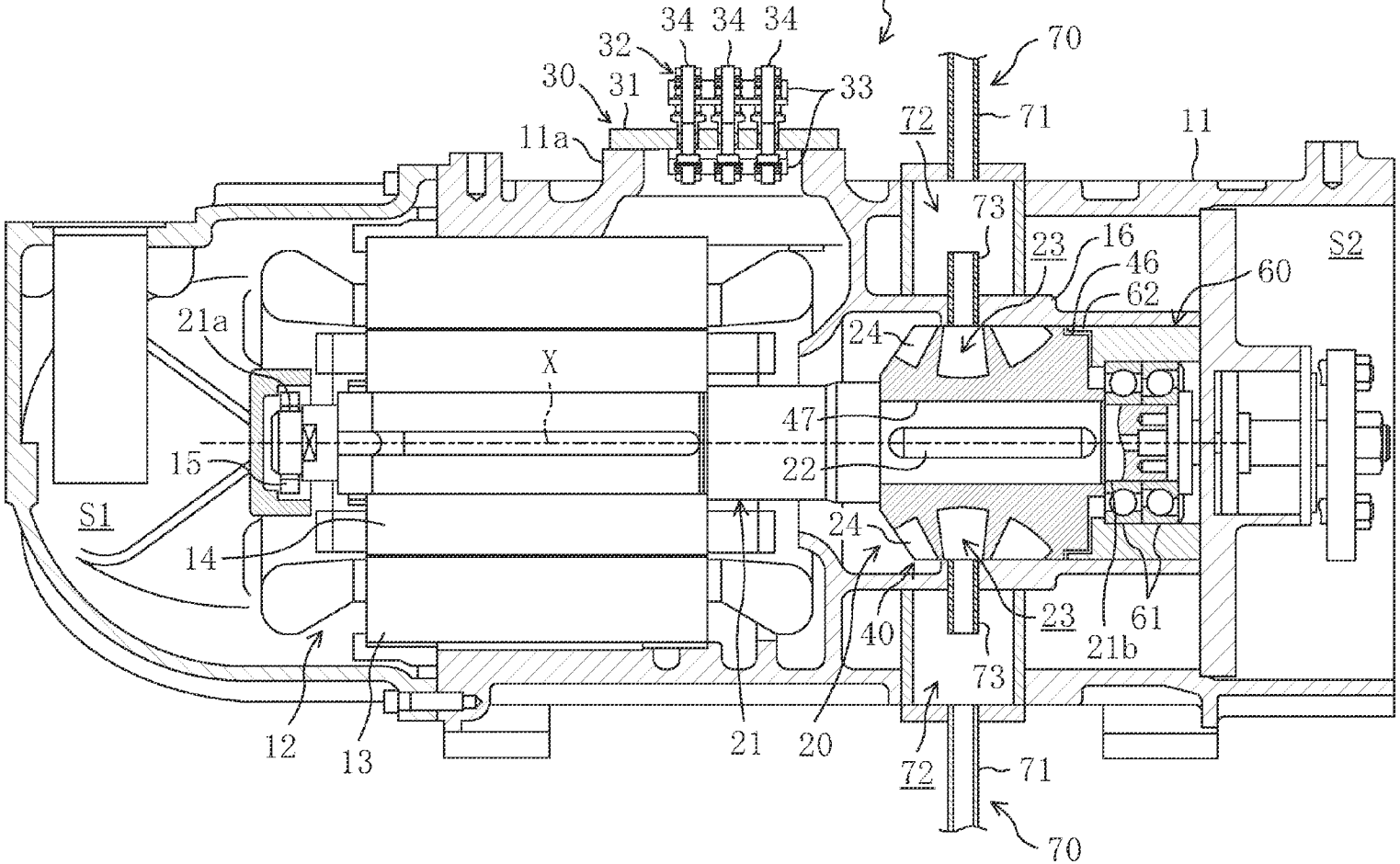
FIG. 2 is a longitudinal cross-sectional view illustrating a configuration of the screw compressor.
Figure 3:
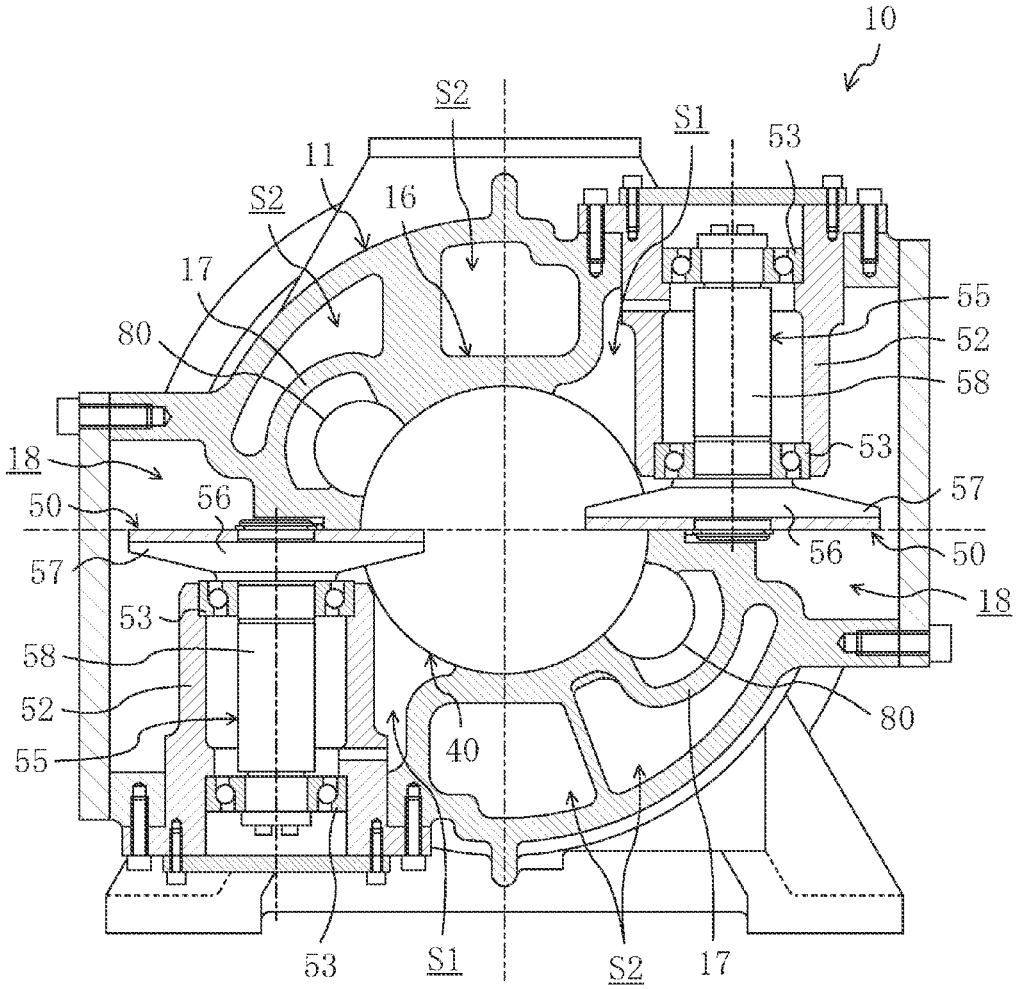
FIG. 3 is a transverse cross-sectional view illustrating the configuration of the screw compressor.

FIG. 2 is a longitudinal cross-sectional view illustrating a configuration of the screw compressor, and FIG. 3 is a transverse cross-sectional view thereof. As illustrated in FIGS. 2 and 3, the screw compressor (10) is hermetic. In the screw compressor (10), a compression mechanism (20), and an electric motor (15) for driving the compression mechanism (20) are housed in a casing (11) made of a metal. The compression mechanism (20) is coupled to the electric motor (12) through a driving shaft (21). The space inside the casing (11) is divided into a low-pressure space (S1) to which low pressure gaseous refrigerant is introduced from the heat-source-side heat exchanger (3) or the utilization-side heat exchanger (4) of the refrigerant circuit (1), and from which the low pressure gaseous refrigerant is guided to the compression mechanism (20), and a high-pressure space (S2) into which high pressure gaseous refrigerant discharged from the compression mechanism (20)

The electric motor (12) includes a stator (13), and a rotor (14). The stator (13) is fixed to the inner peripheral surface of the casing (11) in the low-pressure space (S1). An end of the driving shaft (21) is coupled to the rotor (14), and the driving shaft (21) is configured to rotate around the rotation axis (X) together with the rotor (14).

The compression mechanism (20) includes a cylinder portion (16) formed in the casing (11), one screw rotor (40) disposed in the cylinder portion (16), and two gate rotors (50) engaged with the screw rotor (40).

Figure 4:
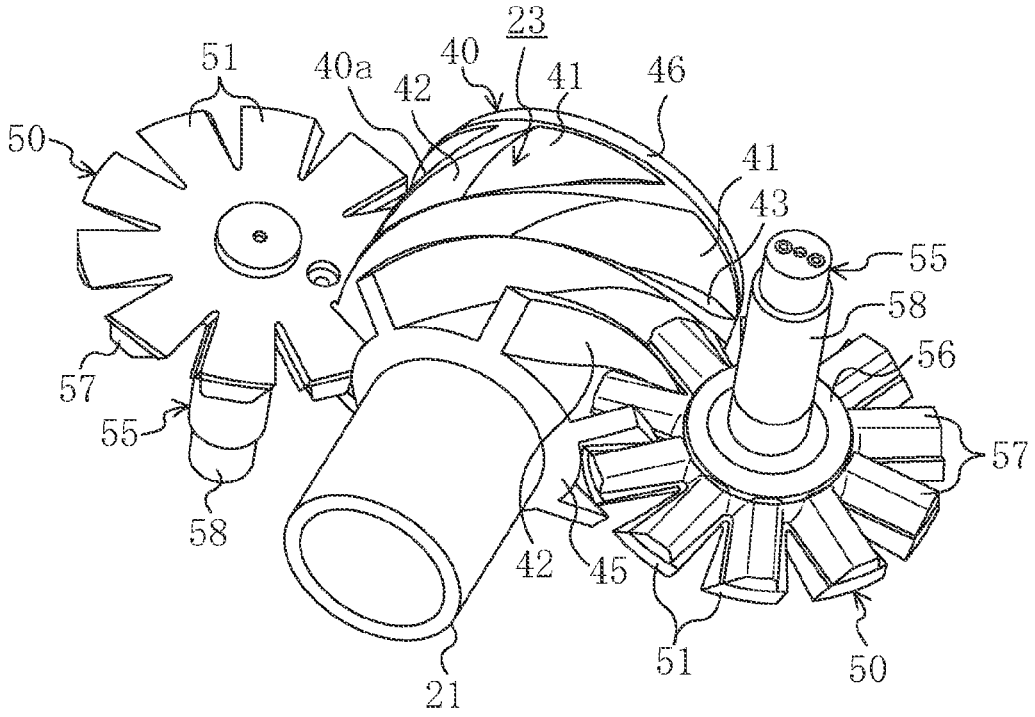
FIG. 4 is a perspective view illustrating only a main portion of the screw compressor.
Figure 5:
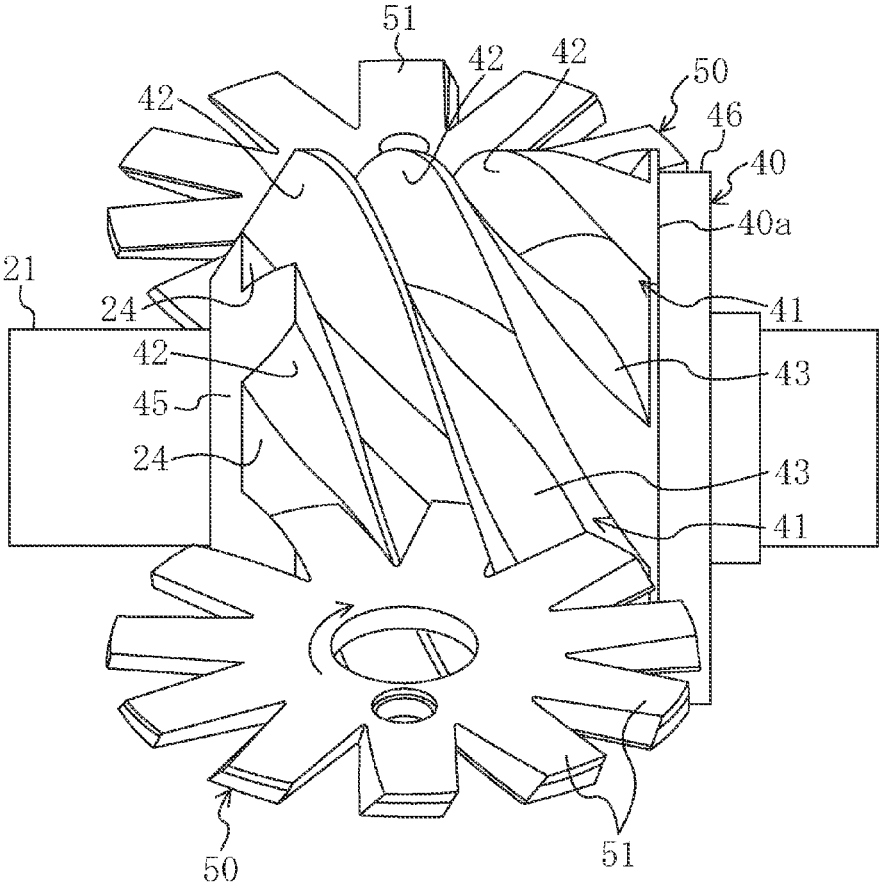
FIG. 5 is a perspective view illustrating only the main portion of the screw compressor when viewed from another angle.

The screw rotor (40) is a metal member having an approximately columnar shape. The outer diameter of the screw rotor (40) is set to he slightly smaller than the inner diameter of the cylinder portion (16), and the outer peripheral surface of the screw rotor (40) is in slidable contact with the inner peripheral surface of the cylinder portion (16). plurality of (six in this embodiment) of helical grooves (41) are formed on the outer periphery of the screw rotor (40) to helically extend from one end to the other of the screw rotor (40) along the axis direction, FIG. 4 is a perspective view illustrating only a main portion of the screw compressor, and FIG. 5 is a perspective view illustrating only the main portion thereof when viewed from another angle. As illustrated in FIGS. 4 and 5, the respective helical grooves (41) of the screw rotor (40) are symmetrical about the axis of the screw rotor (40) having a cylindrical columnar shape (in other words, in the transverse cross-section of the screw rotor (40), the respective helical grooves (41) are symmetrical about the center of the screw rotor (40)). When the helical grooves (41) are symmetrical about a predetermined axis, the axis is called as the axial center of the helical grooves (41). If the helical grooves (41) are accurately formed on the screw rotor (40), the axial center of the helical grooves (41) coincides with the axial center of the screw rotor (40).

A tapered surface (45) is formed in the periphery of an end of the screw rotor (40) in the axis direction, and one ends of the helical grooves (41) are open to the tapered surface (45). The respective starting ends of the helical grooves (41) are the one ends (left end in FIG. 5) of the helical groove (41) open to the tapered surface (45), and the respective terminal ends of the helical grooves (41) are the other ends (right ends in FIG. 5). The terminal ends of the helical grooves (41) are open to a circumferential surface of the other end of the screw rotor (40) in the axis direction thereof. Of opposing side wall surfaces (42,43) of each of the helical grooves (41), one that is located on the front side in the moving direction of the gate (51) is a first side wall surface (42), and one that is located on the rear side in the moving direction of the gate (51) is a second side wall surface (43).

The other end of the screw rotor (40) is provided with a small diameter pipe portion (46) whose outer diameter is smaller than a body (40*a*) in which the helical grooves (41) are formed.

Furthermore, in the screw rotor (40), as illustrated in FIG. 2, a through hole (47) through which the driving shaft (21) passes is formed so as to penetrate the axial center of the screw rotor (40).

As illustrated in FIG. 2, the driving shaft (21) is inserted in the screw rotor (40). At an end of the driving shaft (21), the rotor (14) of the electric motor (12) is coupled, and the other end of the driving shaft (21) is inserted in the through hole (47) of the screw rotor (40). The driving shaft (21) and the screw rotor (40) are coupled together by a key (22). The driving shaft (21) is located on the same axis as the axis of the screw rotor (40).

In this way, the screw rotor (40) and the rotor (14) of the electric motor (12) are coupled together and accommodated in the casing (11). At this time, the screw rotor (40) is fitted into the cylinder portion (16) so as to be rotatable, the outer peripheral surface of the screw rotor (40) is in slidable contact with the inner peripheral surface of the cylinder portion (16).

Figure 6:
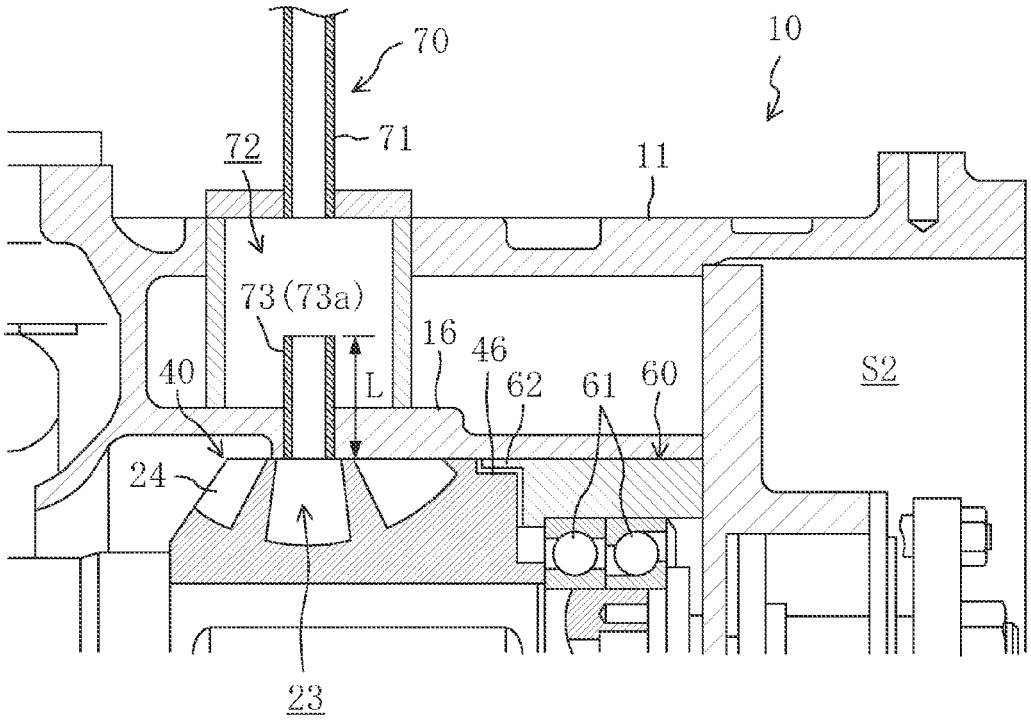
FIG. 6 is a longitudinal cross-sectional view illustrating an enlarged portion of the configuration of the screw compressor.

As illustrated in FIG. 6, the resonance space (72) is provided on the outer periphery of the cylinder portion (16). The resonance space (72) is connected to the downstream side of the branch passage (71) to retain the intermediate pressure refrigerant that has flown from the branch passage (71). The resonance space (72) is provided with the resonance passage (73) having an end communicating with the interior of the compression chamber (23), and the other end protruding toward the interior of the resonance space (72). Specifically, the resonance passage (73) is constituted by a resonance pipe (73*a*) that is cylindrically shaped, and attached to the cylinder portion (16) by being buried into the cylinder portion (16). This configuration allows the intermediate pressure refrigerant flowing through the branch passage (71) to be ejected into the compression chamber (23) in the course of compression via the resonance space (72) and the resonance passage (73).

A distance L[m] from the inner peripheral surface of the cylinder portion (16) to the other end of the resonance passage (73) (in the example illustrated in FIG. 6, the distance L is equal to the total length of the resonance pipe (73*a*)) satisfies the following expression (1):

$$L=c/4f \tag{1}$$

where c is a velocity of sound c[m/s], and f is a resonance frequency f[Hz].

Specifically, if the rotation speed of the screw rotor (40) is 60 Hz, and the number of the helical grooves (41) of the screw rotor (40) (the number of the compression chambers (23)) is six, the suction frequency of the intermediate pressure refrigerant into the compression chamber (23) in the course of compression, i.e., the resonance frequency f[Hz] is expressed by the following expression: f=60×6=360 [Hz]. If the velocity of sound c is 150 [m/s], the distance L from the inner peripheral surface of the cylinder portion (16) to the other end of the resonance passage (73) may be set by the following expression: L[m]=150/(4×360)=0.104 [m].

With such a setting, the resonance frequency of pipe pulsation of the interior of the resonance passage (73) is set to correspond to the suction frequency of the intermediate pressure refrigerant into the compression chamber (23) in the course of compression, and the antinode that is the maximum amplitude in the pipe pulsation is located at an opening end of the inner peripheral surface of the cylinder portion (16). As a result, such a pipe resonance can increase the amount of refrigerant flowing into the compression chamber (23) from the resonance passage (73) to improve refrigeration capacity and refrigeration efficiency.

The sound attenuation effect of the resonance space (72) can reduce the pressure pulsation of the refrigerant flowing through the economizer circuit (70) to achieve low noise. Besides, since another muffler does not have to be provided, cost is advantageously reduced, and the pressure loss of the refrigerant does not increase due to a muffler, and as a result, a sufficient amount of the refrigerant can be maintained. This can sufficiently obtain an economizer effect to improve the performance of the compressor.

The resonance space (72) is provided so as to surround the outer periphery of the cylinder portion (16), thereby allowing the intermediate pressure refrigerant to flow into the resonance space (72) to keep the temperature around the cylinder portion (16) constant. With this configuration, the screw rotor (40) and the cylinder portion (16) do not contact with each other due to the thermal expansion difference between the screw rotor (40) and the cylinder portion (16) due to the temperature difference therebetween, and seizing of the screw rotor (40) can be prevented.

As illustrated in FIG. 2, a first supported portion (21*a*) is formed at an end of the driving shaft (21) to protrude from the rotor (14), and the first supported portion (21*a*) is rotatably supported by a roller bearing (15). A second supported portion (21*b*) is formed at the other end of the driving shaft (21) to protrude from the screw rotor (40), and the second supported portion (21*b*) is rotatably supported by a ball bearing (61) located at the high pressure side of the compression mechanism (20).

The ball bearing (61) is disposed in a bearing holder (60) fitted into the cylinder portion (16) of the casing (11). A wall conical portion (62) is formed in the periphery of an end surface of the bearing holder (60) adjacent to the screw rotor (40) to protrude toward the screw rotor (40).

In the wall conical portion (62), when the screw rotor (40) is disposed within the cylinder portion (16), the small diameter pipe portion (46) of the screw rotor (40) is located inside the inner peripheral side of the wall conical portion (62). In such a configuration, there is a space of small size between the small diameter pipe portion (46) and the wall conical portion (62), and the small diameter pipe portion (46) of the screw rotor (40) and the wall conical portion (62) of the bearing holder (60) do not contact with each other in the radial direction and the axis direction. In other words, there is a space between the small diameter pipe portion (46) and the wall conical portion (62), the space having a profile radially inwardly extending from the outer peripheral surface of the screw rotor (40), bending along the axis direction, and then, radially inwardly bending, and thus, the space bending like a crank in the longitudinal cross-section.

As illustrated in FIGS. 4 and 5, the gate rotors (50) are resin members in which a plurality of rectangular plate-shaped gates (51) (eleven gates in this embodiment) are radially arranged. The respective gate rotors (50) are symmetrically arranged with respect to the screw rotor (40) outside the cylinder portion (16), and the axial center of the gate rotors (50) is orthogonal to the axial center of the screw rotor (40). Each of the gate rotors (50) is disposed such that the gates (51) pass through a part of the cylinder portion (16) and are engaged with the helical grooves (41) of the screw rotor (40).

Each of the gate rotors (50) is attached to a metal rotor supporter (55). The rotor supporter (55) includes a base part (56), arm parts (57), and a shaft part (58). The base part (56) is in the shape of a relatively thick disc. The number of the arm parts (57) is equal to that of the gates (51) of an associated one of the gate rotors (50), and the arm parts (57) radially outwardly extend from. the outer peripheral surface of the base part (56) toward outside. The shaft part (58) has a rod shape, and is formed so as to stand on the base part (56). The central axis of the shaft part (58) coincides with the central axis of the base part (56). Each of the gate rotors (50) is attached to the surfaces of the base part (56) and the arm parts (57) opposite to the shaft part (58). The arm parts (57) are in contact with the back surfaces of the gates 51).

As illustrated in FIG. 3, the rotor supporters (55) to which the gate rotors (50) are attached are housed in gate rotor chambers (18) adjacent to the cylinder portion (16) and defined in the casing (11). In the rotor supporter (55) disposed at the right side of the screw rotor (40) in FIG. 3, the rotor supporter (55) is placed such that the associated gate rotor (50) is located at the lower end of the rotor supporter (55). In the rotor supporter (55) disposed at the left side of the screw rotor (40) in FIG. 3, the rotor supporter (55) is placed such that the associated gate rotor (50) is located at the upper end of the rotor supporter (55). The shaft (58) of each of the rotor supporters (55) is rotatably supported on a bearing housing (52) in the gate rotor chamber (18) with a ball bearing (53) interposed therebetween. Each of the gate rotor chambers (90) communicates with the low-pressure space (S1).

In the compression mechanism (20), a space surrounded by the inner peripheral surface of the cylinder portion (16), the helical grooves (41) on the screw rotor (40), and the gates (51) of the gate rotors (50) serves as a compression chamber (23) (see FIG. 2). The helical grooves (41) on the screw rotor (40) are open to the low-pressure space (S1) at the suction-side ends of the helical grooves (41), and this opening serves as a suction port (24) of the compression mechanism (20).

The screw compressor (10) includes a slide valve (80) as a capacity control mechanism. The slide valve (80) is placed in a slide valve container (17) which is formed with two parts of the cylindrical part (16) expanded radially outward. The slide valve (80) has an inner surface which is flush with the inner side surface of the cylinder portion (16), and is slidable in the axial direction of the cylinder portion (16).

In the slide valve (80), a discharge port, which is not shown, is formed to allow the compression chamber (23) and the high-pressure space (S2) to communicate with each other. In other words, the refrigerant compressed in the compression chamber (23) is discharged from the discharge port of the slide valve (80) to the high-pressure space (S2). In the cylinder portion (16), the upstream end of a bypass passage through which the refrigerant returns from the compression chamber (23) to the low-pressure space (S1) is open, the slide valve (80) opens/closes the upstream end of the bypass passage to adjust the capacity of the compression mechanism (20).

As illustrated in FIG. 2, a pedestal portion (11*a*) is formed in the casing (11). The pedestal portion (11*a*) is formed to protrude from the upper part of the casing (11), and the upper surface thereof is a substantially horizontal flat surface. The pedestal portion (11*a*) is attached to a terminal assembly (30).

The terminal assembly (30) includes a terminal pedestal (31), and a terminal (32). The terminal pedestal (31) is formed in the shape of a rectangular thick plate, and a long side thereof is attached to the upper surface of the pedestal portion (11*a*) such that the long side is substantially in parallel to the axis direction of the casing (11). The lower surface of the terminal pedestal (31) is in contact with the upper surface of the pedestal portion (11*a*).

The terminal (32) is configured to supply the electric motor (12) power, and includes terminal supporters (33), and six terminal rods (34). The terminal supporters (33) are block-shaped members made of, e.g., insulating resins, and are placed on the center of the upper and lower surfaces of the terminal pedestal (31). The terminal rods (34) are metal members, and attached to the terminal supporters (33) such that the axis direction of the terminal rods (34) is a vertical direction.

—Operation—

Operation of the screw compressor (10) will now be described. As illustrated in FIG. 2, in the screw compressor (10), when the electric motor (12) is started, the drive shaft (21) is rotated to allow the screw rotor (40) to rotate. The rotation of the screw rotor (40) causes the gate rotors (50) to rotate, and the compression mechanism (20) repeats a suction stroke, a compression stroke, and a discharge stroke. Here, description will be focused on the compression chamber (23) with dots in FIG. 7.

Figure 7A:
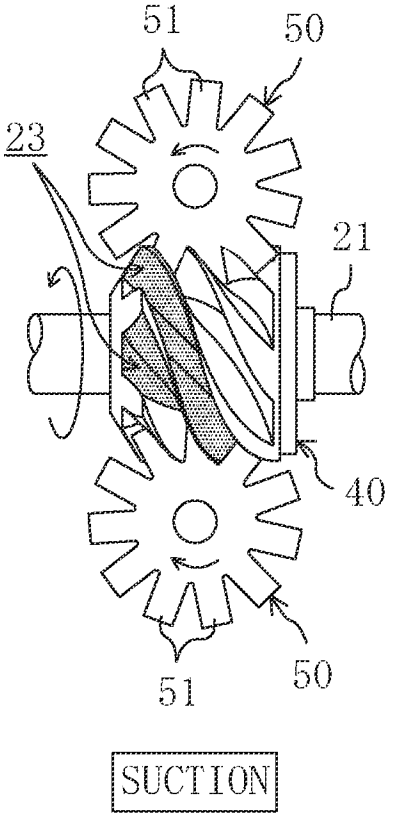
FIGS. 7A-7C are plan views illustrating operations of a compression mechanism of the single-screw compressor.

In FIG. 7A, the compression chamber (23) with dots communicates with the low-pressure space (S1). The helical grooves (41) in which the compression chamber (23) is formed are engaged with gates (51) of the lower gate rotor (50) in FIG. 7A, When the screw rotor (40) rotates, the gates (51) relatively move toward the terminal ends of the helical grooves (41), and the volume of the compression chamber (23) increases accordingly. Consequently, the low-pressure gaseous refrigerant in the low-pressure space (S1) is sucked in the compression chamber (23) through the suction port (24).

Figure 7B:
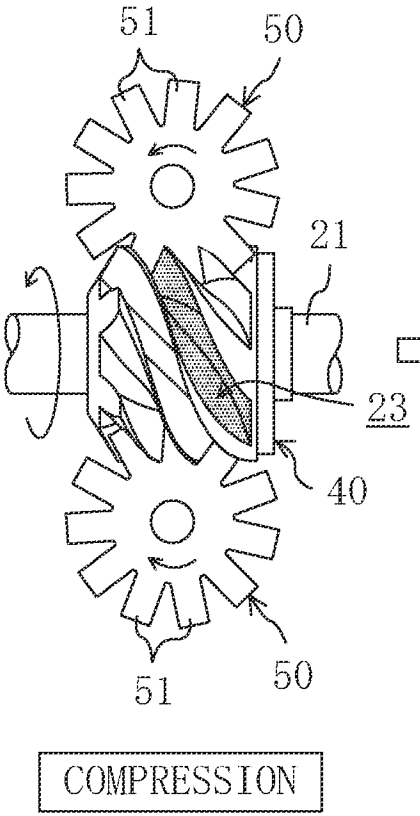

When the screw rotor (40) further rotates, the state illustrated in FIG. 7B is created. In FIG. 7B, the compression chamber (23) with dots are closed. That is, the helical grooves (41) in which the compression chamber (23) is formed are engaged with the gates (51) of the upper gate rotor (50) in FIG. 7B, and are separated from the low-pressure space (S1) by these gates (51). When the gates (51) move toward the terminal ends of the helical grooves (41) with the rotation of the screw rotor (40), the volume of the compression chamber (23) gradually decreases. Consequently, gaseous refrigerant in the compression chamber (23) is compressed.

Figure 7C:
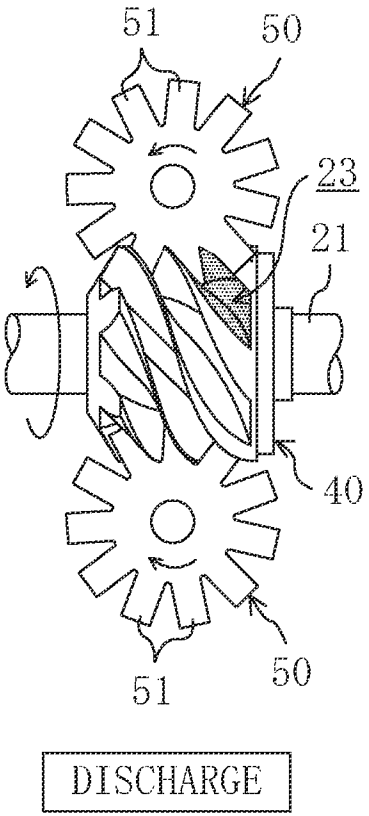

When the screw rotor (40) further rotates, the state illustrated in FIG. 7C is created. In FIG. 7C, the compression chamber (23) with dots communicates with the high-pressure space (S2) through the discharge port (not shown). When the gates (51) move toward the terminal ends of the helical grooves (41) with the rotation of the screw rotor (40), the compressed gaseous refrigerant is discharged from the compression chamber (23) to the high-pressure space (S2).

—Economizer Operation—

Next, the economizer operation of the screw compressor (10) will be described. As illustrated in FIG. 1, high-pressure refrigerant discharged from the high-pressure space (S2) of the screw compressor (10) is condensed in the heat-source-side heat exchanger (3), and then, part of the refrigerant flows into the economizer circuit (70).

The high-pressure refrigerant having flown into the economizer circuit (70) circulates in the branch passage (71), and the pressure of the high-pressure refrigerant is reduced to a predetermined pressure, thereby changing into intermediate-pressure refrigerant. When the intermediate pressure refrigerant passes through the supercooling heat exchanger (65), the intermediate pressure refrigerant exchanges heat with high-pressure refrigerant to change into gaseous refrigerant.

The intermediate pressure refrigerant having passed through the supercooling heat exchanger (65) circulates in the branch passage (71) to flow into the resonance space (72). The intermediate pressure having flown into the refrigerant the resonance space (72) passes through the resonance passage (73) to be ejected into the compression chamber (23) in the course of compression. This can reduce the discharge temperature of the gaseous refrigerant of the screw compressor (10) to a predetermined temperature or less.

<<Second Embodiment>>

Figure 8:
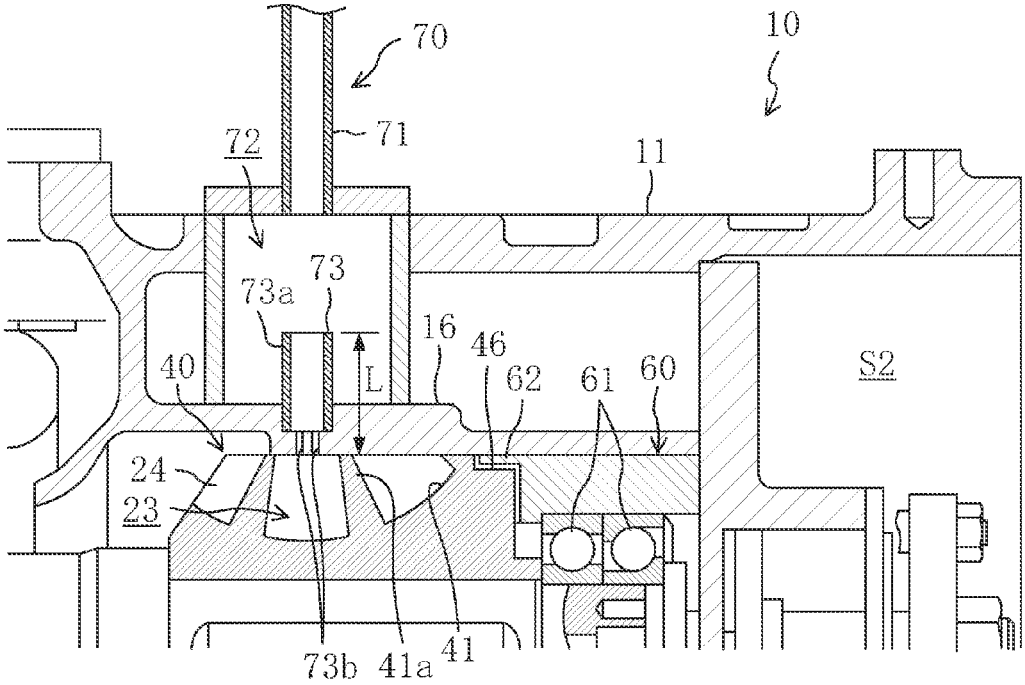
FIG. 8 is a longitudinal cross-sectional view illustrating an enlarged portion of a configuration of a screw compressor according to a second embodiment.
Figure 9:
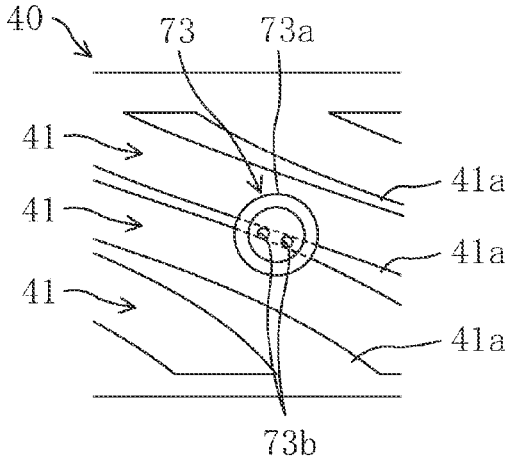
FIG. 9 is a plan view illustrating a configuration of an economizer port.

FIG. 8 is a longitudinal cross-sectional view illustrating enlarged portion of a configuration of a screw compressor according to a second embodiment. FIG. 9 is a plan view illustrating a configuration of an economizer port. The second embodiment is different from the first embodiment in the structure of the resonance passage (73). The same components as those of the first embodiment will be indicated by the same reference characters, and only the difference will be described below.

As illustrated in FIGS. 8 and 9, the resonance passage (73) has the resonance pipe (73*a*) that is cylindrically shaped, and attached to the cylinder portion (16) by being buried into the cylinder portion (16), and two economizer ports (73*b*) formed in the cylinder portion (16).

The economizer ports (73*b*) are formed so as to be arranged within the resonance pipe (73*a*) and along a land portion (41*a*) of one of the helical grooves (41) of the screw rotor (40) when viewed from the pipe axis direction of the resonance pipe (73*a*).

With such a configuration, the intermediate pressure refrigerant circulating in the branch passage (71) flows into the resonance space (72), and then, is sucked into the compression chamber (23) in the course of compression via the resonance pipe (73*a*) and the economizer port (73*b*) of the resonance passage (73). At that time, since the economizer port (73*b*) is closed by the land portions (41*a*) of the helical grooves (41), the adjacent compression chambers (23) do not communicate with each other through the economizer port (73*b*), and as a result, compression efficiency is improved.

A distance L[m] from the inner peripheral surface of the cylinder portion (16) to the other end of the resonance passage (73) (in the example illustrated in FIG. 8, the distance L is equal to the total length of the resonance pipe (73*a*) and the port length of the economizer port (73*b*)) is set to satisfy the expression (1) described above where c is a velocity of sound c[m/s], and f is a resonance frequency f[Hz].

With such a setting, the resonance frequency of pipe pulsation of the interior of the resonance passage (73) is set to correspond to the suction frequency of the intermediate pressure refrigerant into the compression chamber (23) in the course of compression. As a result, such a pipe resonance can increase the amount of refrigerant flowing into the compression chamber (23) from the resonance passage (73) to improve refrigeration capacity and refrigeration efficiency.

Figure 10:
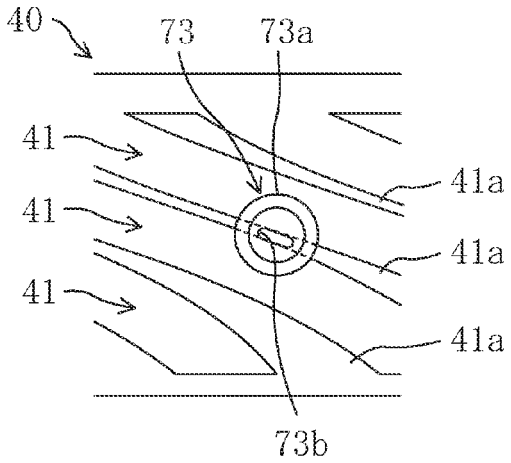
FIG. 10 is a plan view illustrating another configuration of the economizer port.

As illustrated in FIG. 10, an elliptical economizer port (73*b*) may be formed so as to extend within the resonance pipe (73*a*) and along a land portion (41*a*) of one of the helical grooves (41) of the screw rotor (40) when viewed from the pipe axis direction of the resonance pipe (73*a*).

<<Third Embodiment>>

Figure 11:
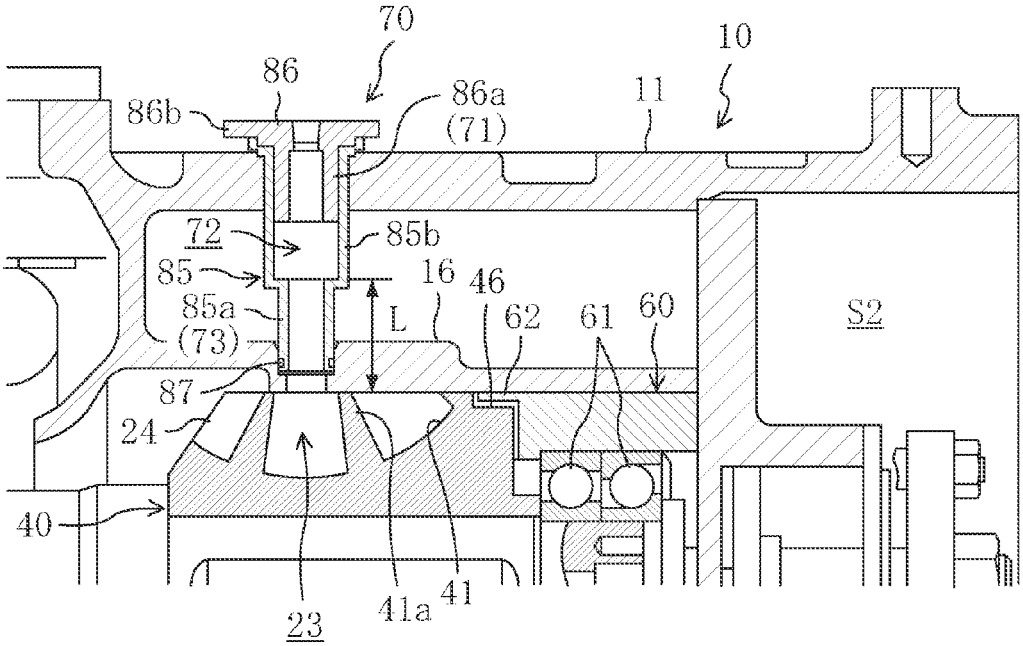
FIG. 11 is a longitudinal cross-sectional view illustrating an enlarged portion of a configuration of a screw compressor according to a third embodiment.

FIG. 11 is a longitudinal cross-sectional view illustrating an enlarged portion of a configuration of a screw compressor according to a third embodiment. As illustrated in FIG. 11, an economizer sleeve (85) is attached to the outer periphery of the cylinder portion (16). The economizer sleeve (85) has a smaller-diameter pipe portion (85*a*) and a larger-diameter pipe portion (85*b*) formed in the shape of a cylinder, having a diameter larger than the smaller-diameter pipe portion (85*a*), and having an end connected to the smaller-diameter pipe portion (85*a*). The downstream end of the smaller-diameter pipe portion (85*a*) is attached to the cylinder portion (16) by being buried into the cylinder portion (16) to communicate with the interior of the compression chamber (23). A seal ring (87) is attached to the outer peripheral surface of the downstream end of the smaller-diameter pipe portion (85*a*). The other end of the larger-diameter pipe portion (85*b*) is open to the exterior of the casing (11).

An economizer flange (86) is attached to the economizer sleeve (85). The economizer flange (86) has a fitted pipe portion (86*a*) fitted into the interior of the larger-diameter pipe portion (85*b*), and a flange portion (86*b*) radially outwardly extending from an end of the fitted pipe portion (86*a*). The length of the fitted pipe portion (86*a*) is shorter than that that of the larger-diameter pipe portion (85*b*).

The resonance passage (73) is defined by the smaller-diameter pipe portion (85*a*) of the economizer sleeve (85). The branch passage (71) is defined by the fitted pipe portion (86*a*) of the economizer flange (86). The resonance space (72.) is a space formed by the inner surface of the larger-diameter pipe portion (85*b*) of the economizer sleeve (85), and the fitted pipe portion (86*a*) of the economizer flange (86).

The interior height of the resonance space (72) is adjustable by moving the economizer flange (86) back and forth with respect to the economizer sleeve (85). This adjustment can provide an appropriate interior height of the resonance space (72) enough to reduce the pressure pulsation of the refrigerant flowing through the economizer circuit (70) by a sound attenuation effect to achieve low noise.

<<Other Embodiments>>

The embodiments described above may have the following structures.

Figure 12:
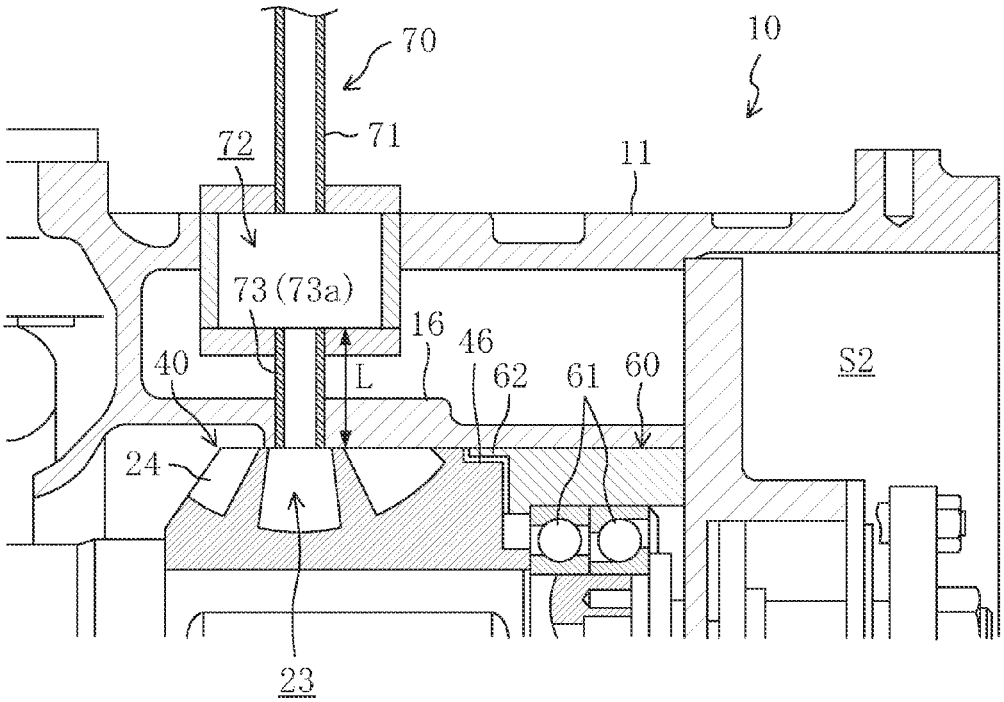
FIG. 12 is a longitudinal cross-sectional view illustrating an enlarged portion of another configuration of the screw compressor.

In the first embodiment, the structure of the upstream end of the resonance passage (73) that protrudes toward the interior of the resonance space (72) is described. However, the present disclosure is not limited to this structure. For example, as illustrated in FIG. 12, the upstream end of the resonance passage (73) may not protrude toward the interior of the resonance space (72). This structure is similar to that of the third embodiment.

Figure 13:
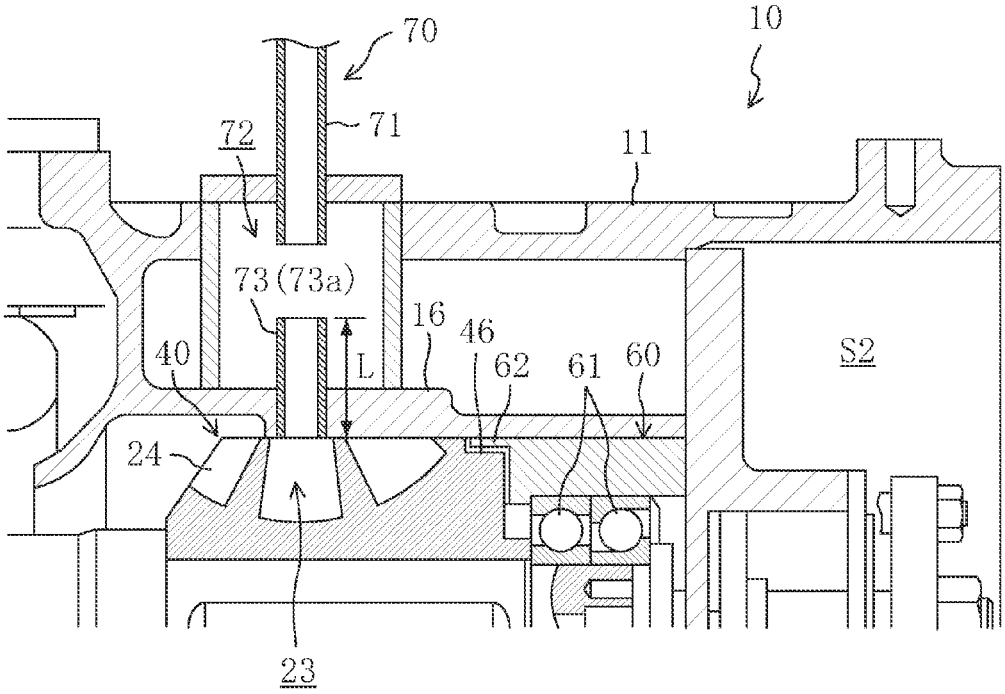
FIG. 13 is a longitudinal cross-sectional view illustrating an enlarged portion of another configuration of the screw compressor.

As illustrated in FIG. 13, the upstream end of the resonance passage (73) may protrude toward the interior of the resonance space (72), while the downstream end of the branch passage (71) may protrude toward the interior of the resonance space (72).

Industrial Applicability

As described above, the present disclosure has a highly practical advantage of maintaining a sufficient amount of the refrigerant ejected from the economizer circuit the interior of the compression chamber to improve the performance of the compressor and reduce noise due to pressure pulsation of the refrigerant. Thus, the present disclosure is very useful and highly applicable in the industry.

What is claimed is:

1. A screw compressor, comprising:

a screw rotor having a plurality of helical grooves formed therein, the helical grooves forming a compression chamber;

a casing having a cylinder portion with the screw rotor inserted therein;

an economizer circuit configured to eject intermediate pressure refrigerant into the compression chamber in a course of compression;

an economizer sleeve including a smaller-diameter pipe portion attached to the cylinder portion and communicating with the interior of the compression chamber, and a larger-diameter pipe portion formed in a shape of a cylinder, the larger-diameter pipe portion haying a diameter larger than a diameter of the smaller-diameter pipe portion, and the larger-diameter pipe portion having an end connected to the smaller-diameter pipe portion and an other end open to an exterior of the casing; and an economizer flange having a fitted pipe portion fitted into an interior of the larger-diameter pipe portion, and a flange portion extending radially outwardly from an end of the fitted pipe portion, the economizer circuit including a branch passage configured to branch the intermediate pressure refrigerant from a portion of a refrigerant circuit that circulates refrigerant and performs a refrigeration cycle, a resonance space connected to a downstream side of the branch passage to retain the intermediate pressure refrigerant, and a resonance passage haying an end communicating with an interior of the compression chamber, and an other end communicating with an interior of the resonance space, the resonance passage being defined by the smaller-diameter pipe portion of the economizer sleeve, the branch passage being defined by the fitted pipe portion of the economizer flange, and the resonance space being a space formed by an inner surface of the larger-diameter pipe portion of the economizer sleeve, and the fitted pipe portion of the economizer flange.

2. The screw compressor of claim 1, wherein the other end of the resonance passage protrudes toward an interior of the resonance space.

3. The screw compressor of claim 2, wherein a downstream end of the branch passage protrudes toward the interior of the resonance space.

4. The screw compressor of claim 1, wherein a distance L from an inner peripheral surface of the cylinder portion to the other end of the resonance passage is set to satisfy $$L = c/4f$$

5. The screw compressor of claim 1, wherein the resonance passage further includes a plurality of economizer ports formed in the cylinder portion to be arranged within the smaller-diameter pipe portion and along a land portion of one of the helical grooves of the screw rotor when viewed from a pipe axis direction of the smaller-diameter pipe portion.

6. The screw compressor of claim 1, wherein the resonance passage further includes an elliptical economizer port formed in the cylinder portion to extend within the smaller-diameter pipe portion and along a land portion of one of the helical grooves of the screw rotor when viewed from a pipe axis direction of the smaller-diameter pipe portion.

* * * * *